US006146319A

United States Patent [19]

Tarail

[11] Patent Number: 6,146,319

[45] Date of Patent: Nov. 14, 2000

[54] EXERCISE GRIP

[76] Inventor: Tanya Tarail, 111 St. Johns Pl., Brooklyn, N.Y. 11217

[21] Appl. No.: 08/831,726

[22] Filed: Apr. 1, 1997

Related U.S. Application Data

[60] Provisional application No. 60/014,574, Apr. 2, 1996.

[51] Int. Cl.[7] ..... A63B 71/00

[52] U.S. Cl. ..... 482/139; 482/44; 482/105; 2/161.1; 2/170; 224/219; 224/267

[58] Field of Search ..... 482/44, 92, 105, 482/106, 108, 139; 2/161.1, 170; 224/218, 219, 222, 267

[56] References Cited

U.S. PATENT DOCUMENTS

| | | | |
|---|---|---|---|
| 4,247,097 | 1/1981 | Schwartz | 482/105 |
| 4,400,831 | 8/1983 | Rietz . | |
| 4,487,412 | 12/1984 | Meeko . | |
| 4,523,781 | 6/1985 | Brody | 623/65 |
| 4,698,850 | 10/1987 | Patton, Sr. et al. | 482/106 |
| 4,720,279 | 1/1988 | Fritschen et al. . | |
| 4,722,523 | 2/1988 | Yang | 482/40 |
| 4,793,005 | 12/1988 | Hetzel, Jr. . | |
| 4,815,731 | 3/1989 | Suarez et al. | 482/124 |
| 5,004,231 | 4/1991 | Alread . | |
| 5,254,060 | 10/1993 | Bohanan | 482/60 |
| 5,324,244 | 6/1994 | Miller et al. . | |
| 5,553,324 | 9/1996 | Emerson | 2/158 |
| 5,620,399 | 4/1997 | Hofmann | 482/49 |
| 5,711,747 | 1/1998 | Steinback | 482/44 |
| 5,809,570 | 9/1998 | Grover | 2/161.1 |
| 5,957,515 | 9/1999 | Van Der Sluys | 224/218 |

*Primary Examiner*—John Mulcahy
*Assistant Examiner*—Victor Hwang
*Attorney, Agent, or Firm*—Ostrolenk, Faber, Gerb & Soffen, LLP

[57] ABSTRACT

An exercise grip and method for its use in coupling an object such as a handle or a weight to the hand of a user. The exercise grip has a body including a base portion with first and second opposing ends for retaining the handle or weight to the base portion. First and second strap portions are attached to and extend from opposite sides of the body along an axis of the body and are sized and shaped to extend around the back of the user's hand with the first strap portion extending between the thumb and forefinger of the user's hand and the second strap portion passing over the metacarpus region of the user's hand. The first and second strap portions meet and are attached to one another around the user's wrist.

14 Claims, 4 Drawing Sheets

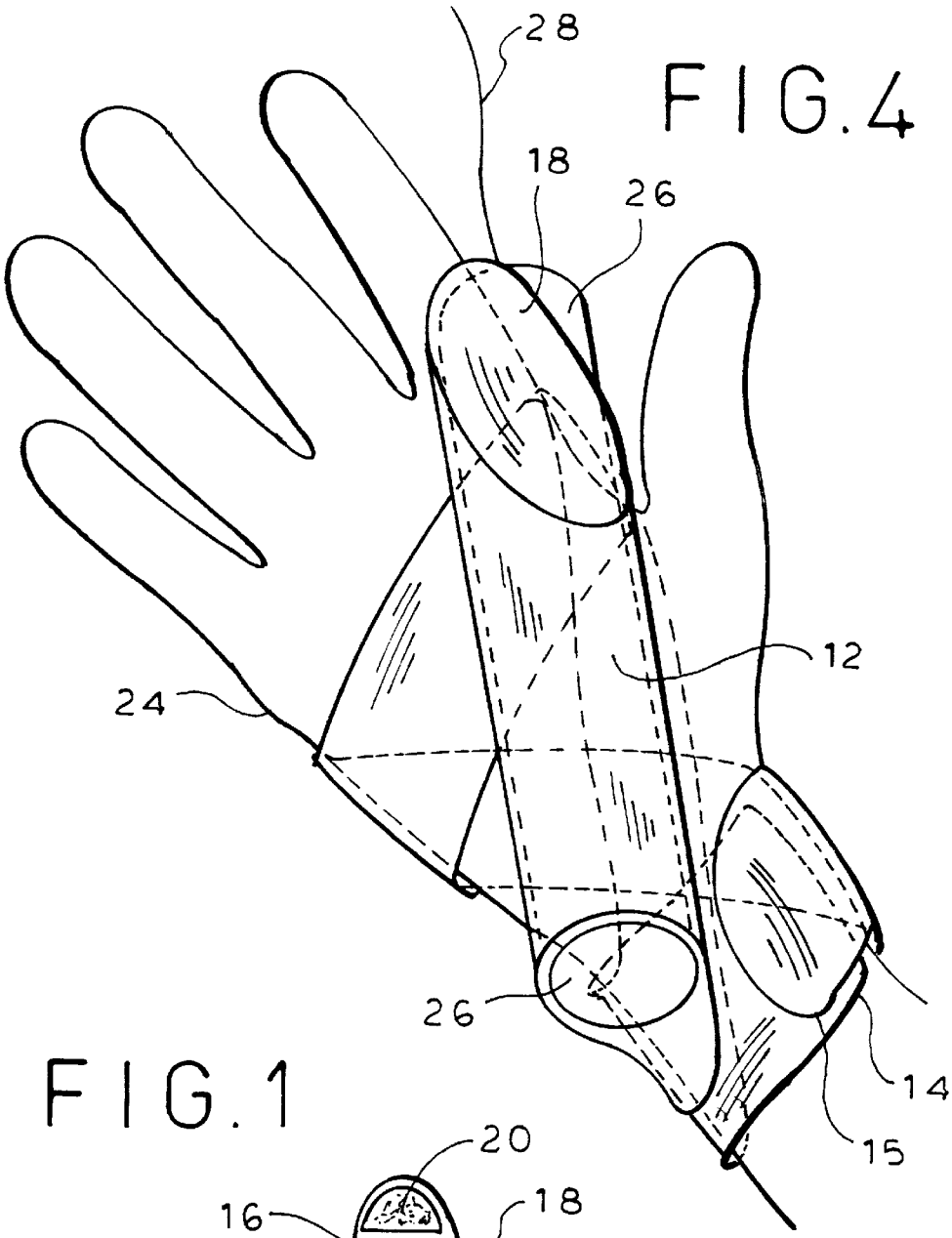
FIG. 4
FIG. 1
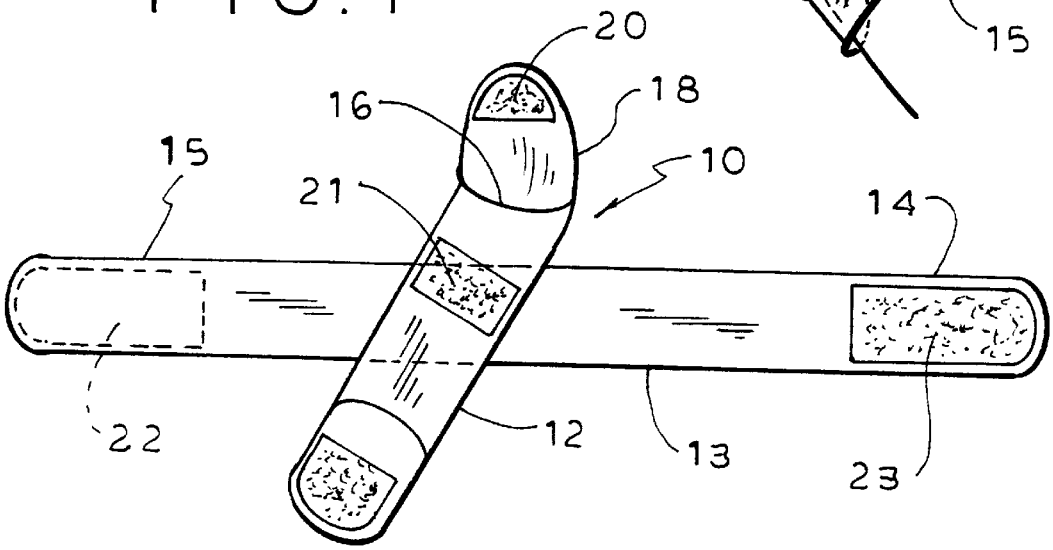

EXERCISE GRIP

CROSS REFERENCE TO RELATED APPLICATIONS

This application claims the benefit of U.S. Provisional Patent Application No. 60/014,574, filed Apr. 2, 1996.

BACKGROUND OF THE INVENTION

1. Field of the Invention

The present invention relates to an exercise grip and more particularly to an exercise grip that can be used to grip a handle or a bar of an exercise device, such as a barbell or a handle of a NORDICTRACK® ski exerciser, without the use of the wearer's fingers or for wearers with limited grip strength.

2. Description of the Art

U.S. Pat. No. 4,793,005 teaches an open-finger sports glove which provides an improved grip on a bar-shaped object. A flexible strap, which is attached to the palm of the glove, may by looped around a bar with the free end of the strap curling back under the fingers. The fingers of the glove and the free end of the strap include a hook and loop material, respectively, to improve the connection. A second strap encircles the wrist, thereby holding the glove in place on the hand.

U.S. Pat. No. 5,004,231 is directed to an exercise glove which includes a strap to improve the user's grip on a bar-shaped object. A cloth loop and a free strap are attached to the glove. The free end of the strap is passed through the loop in order to create a tension about the wrist. The free end of the strap is then passed over and around the object to be gripped and then back under the finger tips. The strap is held in the palm by the pressure of the user's grip. The pull of the bar is therefore distributed to the wrists.

U.S. Pat. No. 4,487,412 discloses a grip device for use in weight lifting which includes a cradle, covered with a soft rubber material, which fits around a bar that is to be gripped. The cradle is attached to the user by a belt which is attached to the bottom edge of the cradle grip and is passed behind the user's wrist.

U.S. Pat. No. 5,324,244 teaches a device to aid in lifting a bar-shaped object which consists of a wide cushioned band which encircles the wrist to give uniform support. A narrow strap and a ring are attached to one side of the band. The narrow strap is wrapped around the wrist and then passed through the ring so that it runs along the palm of the user's hand and can be wrapped around a bar.

U.S. Pat. No. 4,400,831 is directed to a device providing an improved grip on a bar shaped object which includes a glove with a strap which encircles the wrist securing the glove to the hand and with a second strap includes a rib at the fingertips to improve the grip and leverage.

U.S. Pat. No. 4,720,279 teaches a device consisting of two attached straps for improving a user's grip on a bar shaped object. The first strap is a grip strap which includes a protuberant rib and a means for attaching the grip strap to the user's fingers. The second strap is a wrist strap which is wrapped around the user's wrist to secure the device to the user.

None of the prior art teaches an exercise grip which does not require the clenching of the user's fingers to grip a barbell, handle of an exercise device or the like.

SUMMARY OF THE INVENTION

Accordingly, it is an object of the present invention to provide an exercise grip which does not require the clenching of the user's fingers to grip a barbell, handle of an exercise device or the like.

Another object is to provide such an exercise grip which can be used by wearers with limited grip strength.

A further object is to provide such an exercise grip that can be used to grip the handle of a ski-exerciser or the like.

It is also an object to provide such an exercise grip that can be used to grip the handle of a barbell or the like.

It has been found that the above and other objects of the present invention are attained in an exercise grip that includes a body having a cavity and an open end leading to the cavity where the cavity is adapted to receive and retain the handle. The body includes a flap to retain the handle in the cavity and a strap attached to the body to secure the body and the handle to the user's hand.

According to an alternative embodiment of the present invention, an exercise grip includes a body having a base portion for receiving the handle and first and second opposing ends for retaining the handle in the base portion. The grip also includes a strap attached to the body to secure the body and the handle the user's hand.

Other features and advantages of the present invention will become apparent from the following description of the invention which refers to the accompanying drawings.

BRIEF DESCRIPTION OF THE DRAWING(S)

For the purpose of illustrating the invention, there is shown in the drawings an embodiment which is presently preferred; it being understood, however, that the invention is not limited to the precise arrangements and instrumentalities shown.

FIG. 1 is a perspective view of the exercise grip of the present invention.

FIG. 4 is a top plan view of the exercise grip of the present invention shown attached to the handle of a ski exerciser.

DETAILED DESCRIPTION OF THE INVENTION

Figure 2:
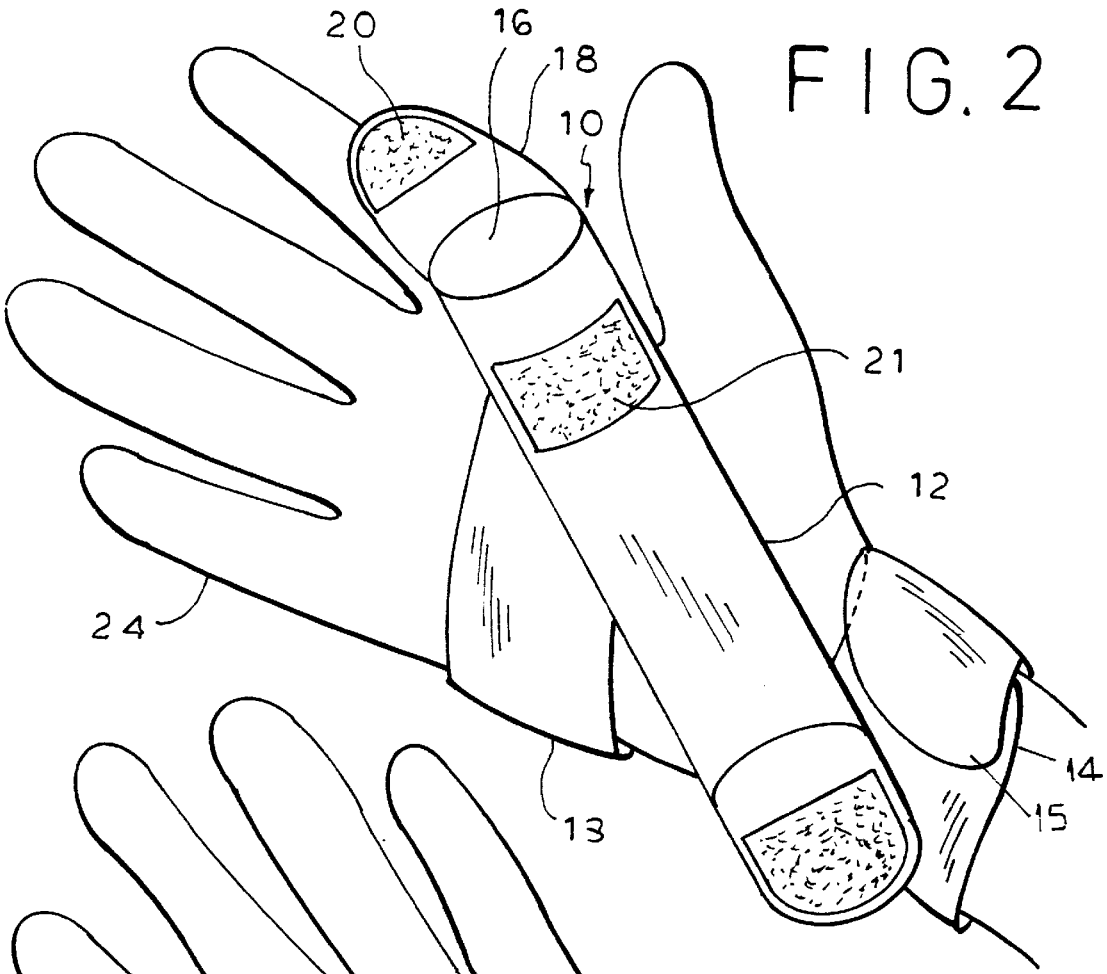
FIG. 2 is a top plan view of the exercise grip of FIG. 1 attached to a wearer's hand.

Referring now to-the drawings wherein like numerals indicate like elements, there is shown in FIG. 1 the exercise grip 10 of the present invention. The exercise grip 10 includes a grip body 12 attached to a strap 13. The strap 13 includes opposing ends 14, 15. An attachment means such as hook and loop fastener portions 22, 23, i.e., VELCRO®, are attached to the opposing ends 14, 15, although any of the known attachment means can be used.

The body portion 12 includes a recess or cavity 16 adapted to receive a handle 26 of a ski exerciser such as a NORDICTRACK® or the like, FIG. 4. Preferably, the body portion 12 is made from LYCRA® or any other elastic material. It should be realized by those skilled in the art that the body portion 12 can be made from any of the known materials including leather, leatherette, nylon, spandex or any combination of these materials.

The body portion 12 includes a flap 18 adapted to secure the handle 26 in the recess 16. The body portion 12 also includes fastener portions 20, 21 (preferably VELCRO® portions) to close the flap 18 to secure the handle in the cavity 16.

Figure 3:
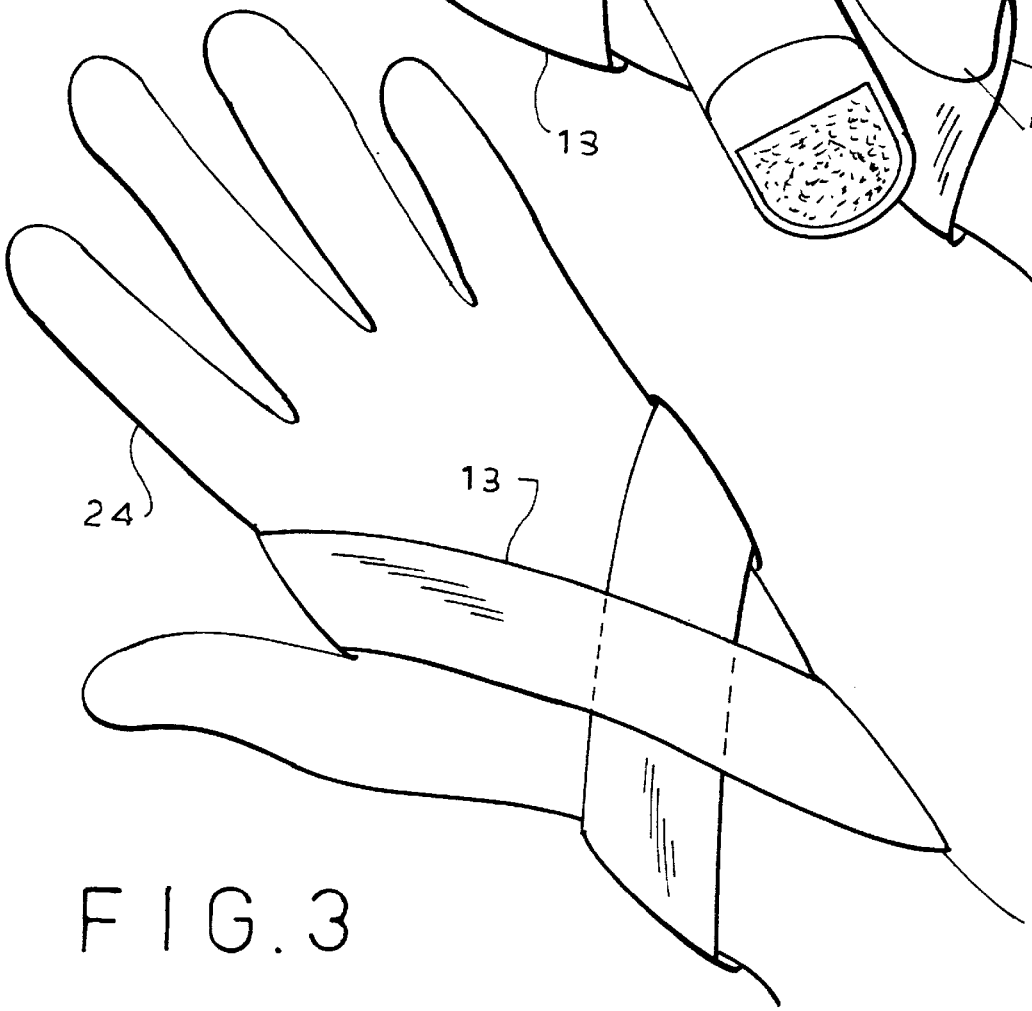
FIG. 3 is a top plan view of the opposite side of the wearer's hand of FIG. 2.

Referring now to FIGS. 2, 3, the exercise grip 10 is shown attached to a wearer's hand 24. To attach the exercise grip 10 to the wearer's hand 24, the exercise grip body 12 is placed in the palm of the user's hand 24. The strap 13 is then wrapped around the back of the user's hand 24 in a criss-cross fashion, FIG. 3. The ends 14, 15, of the strap 13 wrap around the user's wrist. The strap 13's VELCRO® portions 22, 23 are then used to tightly secure the strap 13 around the wearer's wrist.

Preferably, the strap 13 is made of a sturdy material. This is because the strap 13 stabilizes the user's wrist to ensure proper wrist support when the exercise grip 10 is in use.

Preferably, the body portion 12 is elongate along an axis to receive an elongate handle 26 and the elongate axis is disposed at an angle (preferably less than about 90°) with respect to the strap such that, in use, the body portion is properly positioned in the wearer's hand 24 (FIGS. 1 and 4).

Referring now to FIGS. 2 and 4, in use, the handle 26 is inserted in the recess 16 of the body portion 12. The flap 18 is then folded over the handle 26 until it is secured in the body portion 12 by the VELCRO® portions 20, 21. The flap 18 keeps the handle 26 in the body portion 12 during use. Preferably, the flap 18 is made of LYCRA® or any other elastic material to tightly secure the handle 26 in the recess 16, although it should be realized that the flap 18 can be made from any of the known materials.

The handle 26 has a string or cord 28 attached thereto. In order for the flap 18 to work in connection with the cord 28, the flap 18 should have an opening to allow the cord 28 to pass therethrough, not shown. Preferably, the flap 18 is arranged so that it engages the handle 26 adjacent to the cord 28, FIG. 4.

In use, with the handle 26 held securely in place in the body portion 12, the exercise grip wearer 24 can now use the NORDICTRACK® or other exerciser in the normal course, without the need for the wearer's fingers to actually grip the handle 26.

Figure 8:
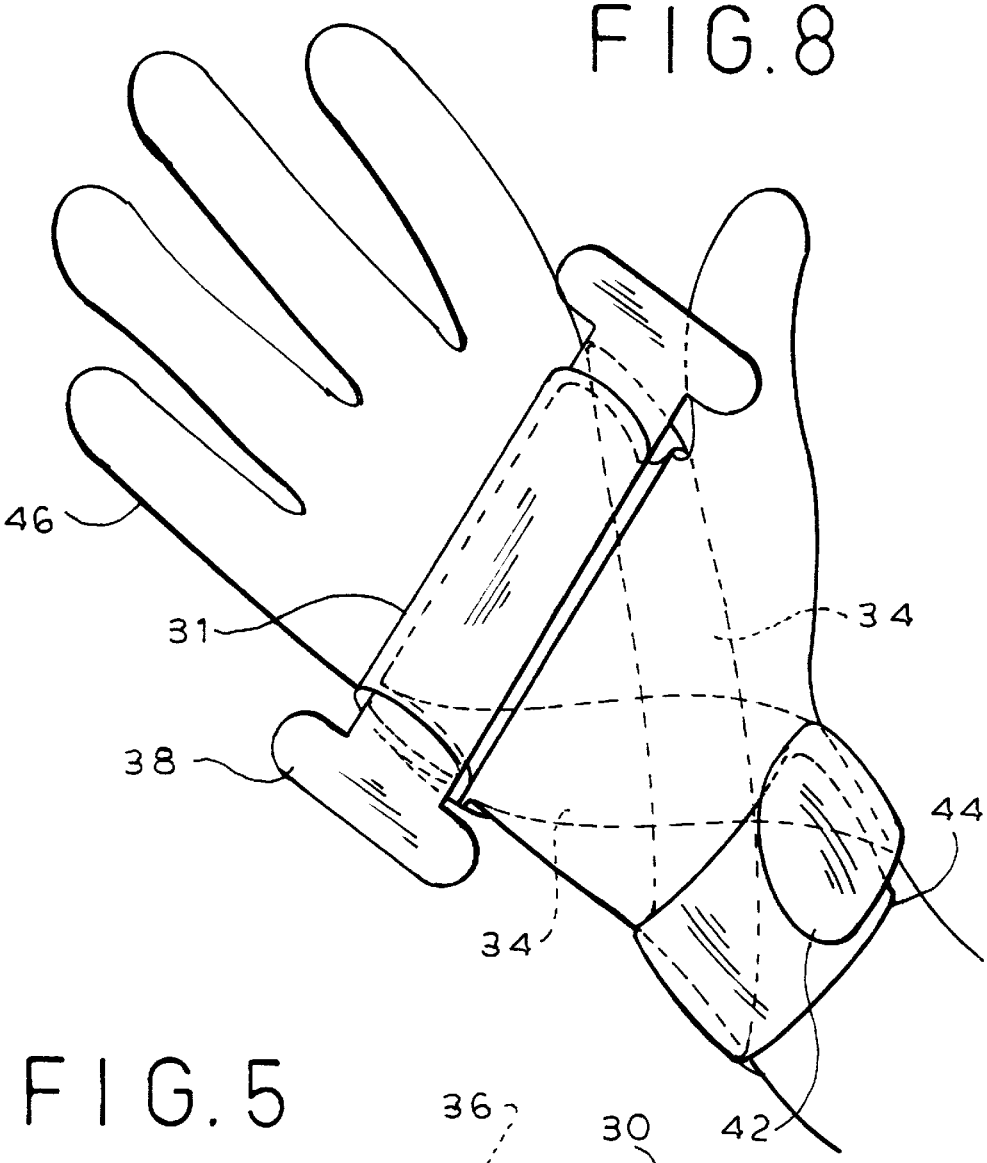
FIG. 8 is a top plan view of the exercise grip of FIG. 5 in use and shown attached to a free weight.
Figure 5:
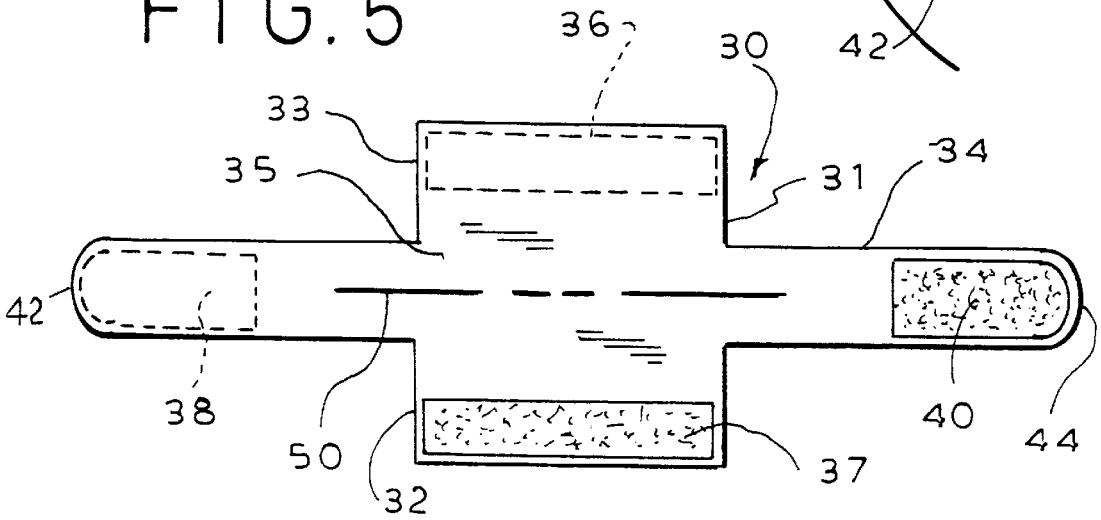
FIG. 5 is a perspective view of an alternative embodiment of the exercise grip of the present invention.

Referring now to FIGS. 5–8, an alternative embodiment 30 of the exercise grip of the present invention is shown therein. The exercise grip 30 includes a body portion 31 and a strap 34. The body portion 31 includes a base portion 35 (having an axis 50) to receive barbell like objects, such as a free weight 38 (FIG. 8). The body portion 31 also includes opposing ends 32, 33 to retain the barbell like objects in the body portion 31. The strap 34 includes opposing ends 42, 44. Each of the ends 32, 33 and 42, 44 include VELCRO® portions 36, 37 and 39, 40, respectively.

Like the exercise grip 10, the body portion 31 of the exercise grip 30 can be made of LYCRA® or any other elastic material. The body portion 31 can also be made of other materials known to those skilled in the art including leather, leatherette, nylon, spandex or any combination of these materials.

Figure 6:
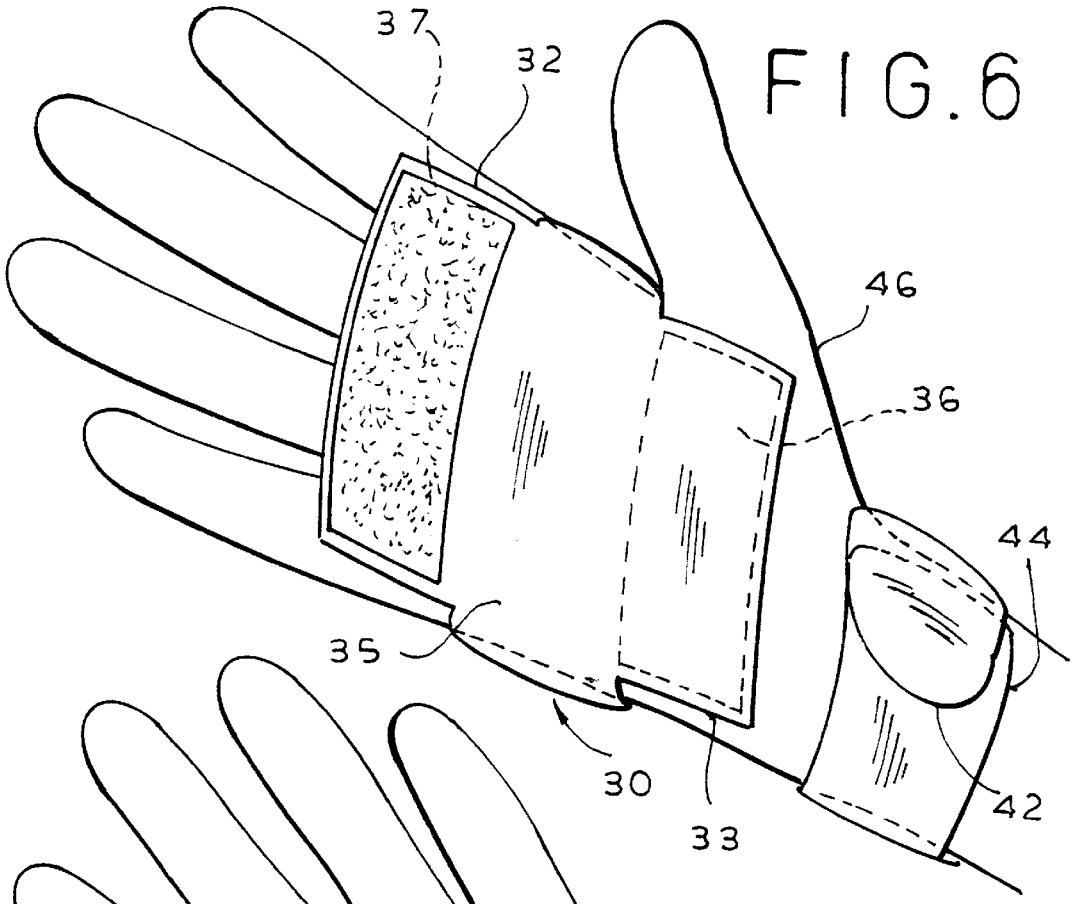
FIG. 6 is a top plan view of the exercise grip of FIG. 5 attached to a wearer's hand.
Figure 7:
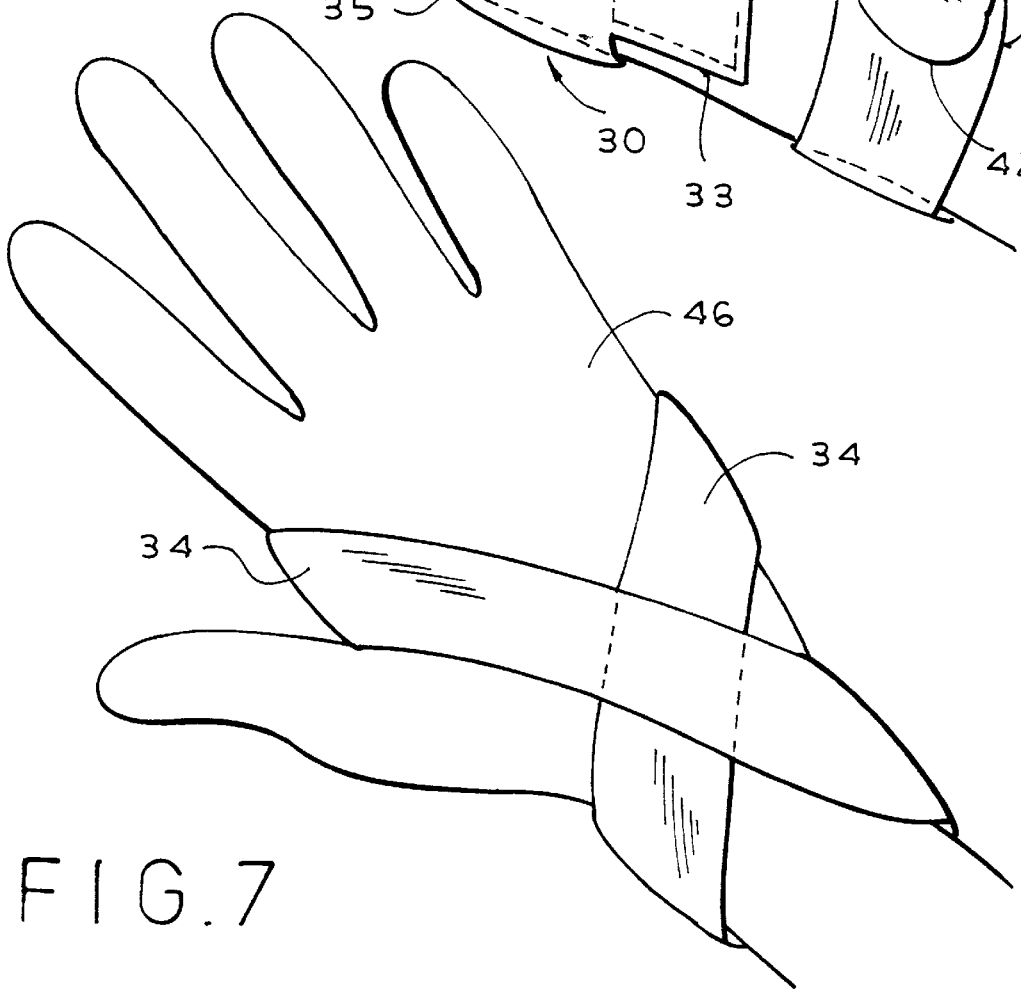
FIG. 7 is a top plan view of the opposite side of the wearer's hand of FIG. 6.

Referring now to FIG. 6, the alternative embodiment exercise grip 30 is shown wrapped around a wearer's hand 46. To attach the exercise grip 30 to the wearer's hand 46, the exercise grip 30 is placed in the palm of the wearer's hand 46. The strap 34 is then wrapped around the back of the wearer's hand 46 in criss-cross fashion, FIG. 7. The ends 42, 44 of the strap 34 wrap around the user's wrist. The strap 34's VELCRO® portions 39, 40 secure the strap 34 around the wearer's wrist. Like the strap 13 described above, the strap 34 should be made of a sturdy material to stabilize the wrist and ensure proper wrist support when the exercise grip 30 is in use, FIG. 7.

Referring now to FIG. 8, the free weight 38 is secured in wearer's hand 46. This is accomplished by placing the free weight 38 in the base 35 of the body 31 and folding over the ends of the body portions 32, 33 around the free weight 38. The body portion 31 is secured to the free weight 38 by use of the VELCRO® portions 36, 37.

As the result of the exercise grip of FIG. 8, the free weight 38 is secured to the user 46's hand without use of the wearer's fingers.

In summary, the exercise grip of the present invention does not require the clenching of the user's fingers to grip a bar shaped handle or the like. It can be used by wearers with limited grip strength. It can also be used to grip the handle of a ski-exerciser or to grip the handle of a barbell or the like.

Although the present invention has been described in relation to particular embodiments thereof, many other variations and modifications and other uses will become apparent to those skilled in the art.

What is claimed is:

1. A combination of an object and an exercise grip, said exercise grip for securing said object to a hand of a user, said combination comprising:

a body having a base portion for receiving said object and first and second opposing ends for retaining said object in said base portion;

first and second strap portions attached to and extending from opposite sides of said body along an axis of said body to secure said body and said object to the user's hand, said first and second strap portions being sized and shaped to extend around the back of said user's hand such that (i) said first strap portion passes between the thumb and forefinger of the user, and (ii) the second strap portion passes over the metacarpus region of the user's hand, and (iii) said first and second strap portions meet and attach to one another around the user's wrist; and said object including one of a handle and a weight disposed within said base portion;

whereby said one of a handle and a weight is secured to the user.

2. The exercise grip of claim 1, wherein the first and second opposing ends are sized and shaped to wrap around the object such that the object is secured to the base portion.

3. The exercise grip of claim 1, wherein the first and second opposing ends include first and second fastener portions for securing the first and second ends together.

4. The exercise grip of claim 3, wherein the first and second fastener portions include hook and loop portions.

5. The exercise grip of claim 1, wherein the first and second strap portions include third and fourth respective opposing ends having third and fourth fastener portions for securing the third and fourth ends together.

6. The exercise grip of claim 5, wherein the fastener portions include hook and loop portions.

7. The exercise grip of claim 1, wherein the body is elongate along the axis, the axis being disposed substantially parallel with respect to the extending first and second strap portions.

8. The exercise grip of claim 1, wherein the first and second strap portions include third and fourth respective opposing ends having third and fourth fastener portions for securing the ends together, the first and second strap portions being sized to wrap around the user's wrist such that the ends of the strap portions may be securely fastened together.

9. The exercise grip of claim 1, wherein the body is made from an elastic material.

10. The exercise grip of claim 9, wherein the body is made from at least one material taken from the group consisting of leather, leatherette, nylon, and spandex.

11. A method of coupling a handle to a hand of a user, said method comprising:

providing a grip having a body and first and second strap portions extending from opposite sides of said body along an axis of the body, said first and second strap portions being sized and shaped to extend around the back of said user's hand such that (i) said first strap portion passes between the thumb and forefinger of the user, and (ii) the second strap portion passes over the metacarpus region of the user's hand, and (iii) said first and second strap portions meet and attach to one another around the user's wrist;

securing said handle in a base portion of said body, said base portion having first and second opposing ends; and wrapping said first and second strap portions around said hand thereby coupling said handle to said user.

12. The method as claimed in claim 11 wherein said step of securing comprises the further step of:

overlapping said opposing ends of said base portion.

13. A method of coupling a weight to a hand of a user, said method comprising:

providing a grip having a body and first and second strap portions extending from opposite sides of said body along an axis of the body, said first and second strap portions being sized and shaped to extend around the back of said user's hand such that (i) said first strap portion passes between the thumb and forefinger of the user, and (ii) the second strap portion passes over the metacarpus region of the user's hand, and (iii) said first and second strap portions meet and attach to one another around the user's wrist;

securing said weight in a base portion of said body, said base portion having first and second opposing ends; and wrapping said first and second strap portions around said hand thereby coupling said weight to said user.

14. The method as claimed in claim 13 wherein said step of securing comprises the further step of:

overlapping said opposing ends of said base portion.

* * * * *